United States Patent [19]

Heemstra

[11] 4,267,784

[45] May 19, 1981

[54] TUFTING MACHINE

[76] Inventor: Theodore C. Heemstra, 958 Hollywood, NE., Grand Rapids, Mich. 49505

[21] Appl. No.: 99,021

[22] Filed: Nov. 30, 1979

[51] Int. Cl.[3] ..... D05C 15/00

[52] U.S. Cl. ..... 112/80

[58] Field of Search ..... 112/80, 169, 79 R, 79 FF; 223/104

[56] References Cited

U.S. PATENT DOCUMENTS

| | | | |
|---|---|---|---|
| 2,057,920 | 10/1936 | Rose | 112/80 |
| 2,078,258 | 4/1937 | Lundgren | 1128/80 |
| 3,142,276 | 7/1964 | Schauer | 112/80 |
| 3,430,590 | 3/1969 | Looper | 112/80 |
| 3,645,219 | 2/1972 | Jenkins | 112/80 |
| 3,867,888 | 2/1975 | Morissette | 112/80 |
| 3,968,758 | 7/1976 | Scholz | 112/80 |
| 4,132,182 | 1/1979 | Heemstra | 112/79 R |

FOREIGN PATENT DOCUMENTS

| | | | |
|---|---|---|---|
| 853635 | 3/1940 | France | 112/80 |
| 7107 | of 1907 | United Kingdom | 112/80 |

*Primary Examiner*—Ronald Feldbaum

*Attorney, Agent, or Firm*—Price, Heneveld, Huizenga & Cooper

[57] ABSTRACT

An improved tufting machine for forming loop or cut pile tufts in a backing material from at least one continuous strand of yarn. The machine includes a hollow, channel-like needle reciprocally inserted through a backing material followed by a plunger which pushes a length of yarn through the opening provided by the needle. A cutting blade may be slidingly supported between the needle and plunger and reciprocated outwardly to cut the formed loop. The machine may be adjusted to leave the formed loops uncut or to change the height of the loop or cut pile tufts. The needle, plunger and cutting blade are separately reciprocated by rotating cranks. Yarn holding mechanisms are provided on both sides of the needle to insure that the loops or cut pile are formed to a precise, even height across the backing. One of the yarn holding mechanisms, preferably on the trailing side of the needle, is operated by a camming apparatus independently of the needle, plunger and cutting blade so that the yarn will be held during a predetermined, precisely controlled, portion of the loop forming and cutting operation. The machine also includes improved yarn control mechanisms, machine support handle, cutting blade holding and reciprocating mechanisms, and lubrication means.

32 Claims, 22 Drawing Figures

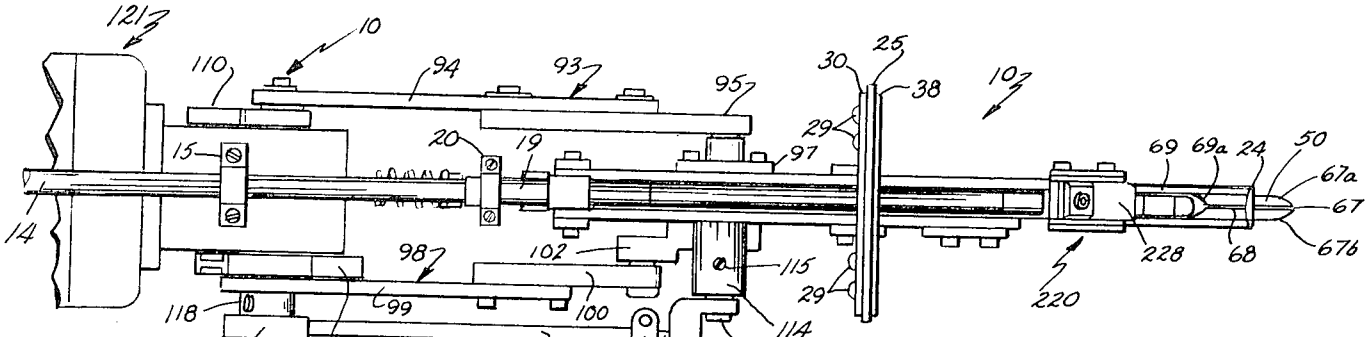
Fig. 4.
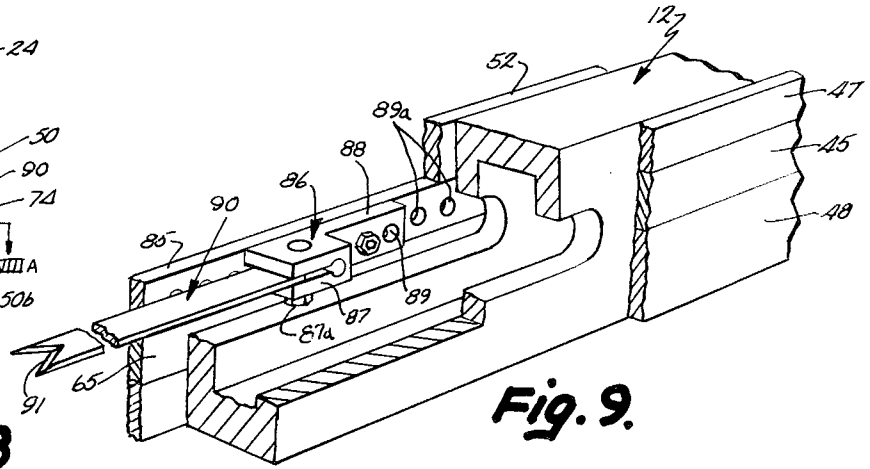
Fig. 9.
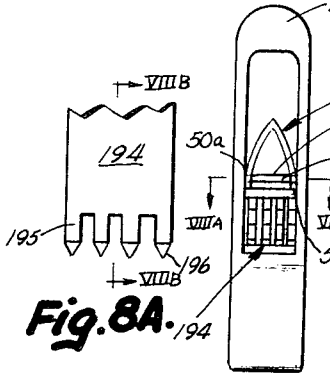
Fig. 8
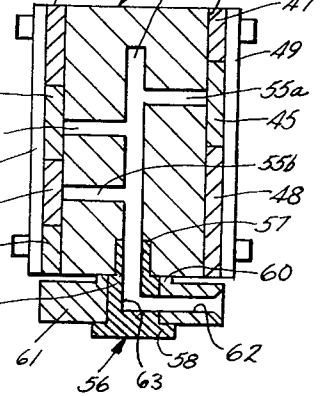
Fig. 8A.
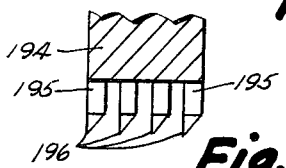
Fig. 8B.
Fig. 7.

TUFTING MACHINE

BACKGROUND OF THE INVENTION

This invention relates to a machine for forming tufts of yarn through woven fabric or other backings to form carpets, wall hangings or the like and, more particularly, to an improved tufting machine for forming loop or cut pile tufts in a backing material from at least one continuous strand of yarn.

U.S. Pat. No. 4,132,182 discloses my previous hand held, motor driven tufting machine which provided a significant improvement and tremendous advance over prior known tufting machines. My prior machine includes a hollow needle for forming an opening through a backing fabric cooperating with a yarn plunger and cutting blade for forming loop or cut pile tufts through the opening in the fabric provided by the needle. The plunger and cutting blade are nested together and within the needle. The plunger itself operates a yarn hold device on one side of the needle to secure the yarn against the backing to hold the previously formed loop in place while a yarn latch on the opposite side of the needle holds the yarn during any cutting of the yarn to form cut pile tufts.

Following experimentation and use of my prior machine shown in U.S. Pat. No. 4,132,182, I desired to provide a more exact uniformity in the formation of loop and cut pile tuft heights or lengths to further reduce the necessity of shearing or other finishing operations which require expensive labor to complete a carpet or wall hanging. More specifically, better control of the yarn holding devices was desired especially in relation to the operation of the needle, plunger and cutting blades.

It was also desired to provide easier and better adjustment for changing to different lengths of cut pile tufts and loop tufts and to allow a greater range of such lengths while maintaining the critical uniformity and evenness in the selected lengths within the increased range.

Further, other desired improvements included strengthened construction for better support and control of the tufting machine during use, better lubrication ability for the mechanisms of the machine, better yarn control during operation, and prevention of withdrawal of yarn from the yarn guide areas when moving the machine from area to area across a fabric backing during use.

The present invention provides the above improvements over my prior known tufting machines as well as additional unexpected advantages.

SUMMARY OF THE INVENTION

Accordingly, the present invention provides a tufting machine for providing uniform, consistently even loop or cut pile tufts at a faster speed with better control of the tufting machine and which require less shearing or finishing operations to complete the carpet or wall hanging. The improved machine combines a crank operated needle, plunger and cutting blade together with a cam operated, independently controlled yarn hold mechanism which significantly improves the retention of the yarn in the previously formed tufts on one side of the needle. Together with a second yarn holding mechanism or latch on the opposite side of the needle, yarn is more consistently and evenly held to provide highly uniform loop or cut pile tufts. Slight stretch in the yarn during loop formation and cutting is accounted for by the yarn hold mechanisms and machine timing. In addition, the present invention provides easier adjustment and timing of the various components of the machine especially when changing between loop or cut pile tufts and various lengths of the loop or cut pile tufts. The improved tufting machine also is sturdier in construction, provides better control during operation, is susceptible to easier lubrication, and prevents time consuming loss of yarn when moving the machine from place to place around a fabric backing during use.

In one form, the present invention is an improvement in a tufting machine of the type for forming loop or cut pile fabrics including an elongated, rigid support arm, first means on the support arm for engaging a backing material, and second means on the support arm for forming successive loop tufts from a continuous length of yarn in the backing material and for cutting the loop tufts when desired. The machine also includes yarn holding means on at least one side of the second means for holding the yarn of at least one previously formed loop against the backing material on that one side during cutting and/or forming of the loop or cut pile tufts. The improvement comprises a drive means for operating the second means and yarn holding means including crank means for operating the second means and camming means for operating the yarn holding means independently of the second means during a predetermined portion of the operation of the second means.

In a preferred embodiment, the camming means includes a camming surface on a rotating shaft engaging a reciprocating means operating a yarn gripping member to hold any previously formed yarn loops or tufts against the backing material during a period beginning at least simultaneously with the entry of the loop-forming plunger through the backing, extending through the entire loop forming and any loop cutting operation, and ending after or at least simultaneously with the withdrawal of the cutting blade through the backing following any cutting of the formed loop. Further, the reciprocating yarn gripping member is preferably operated by connecting means slidably telescoped through a hollow tube which also provides a sturdy support for the backing engaging foot of the machine.

In other aspects, the tufting machine includes an improved yarn guiding means including a yarn engaging means for holding the yarn within the guide means and a U-shaped guide member on the second yarn holding means or yarn latch on the opposite or leading side of the second means or needle, plunger and cutting blade combination, an improved swivel handle for controlling the machine, improved crank connections for ease in adjustment, an improved cutting blade holding mechanism, and an improved lubrication system.

The above improvements and others described herein provide significant advantages over my prior known tufting machine and other prior known structures. The rear or trailing yarn hold camming mechanism enables faster speeds with minimal vibration because of the minimal mechanical and reciprocal movement involved. Timing of that cammed yarn hold is improved since it is independent of the needle, plunger and cutting blade, is easier to adjust, and provides more effective yarn hold because it can be operated earlier, held longer, and withdrawn later than prior yarn hold mechanisms. In addition, the yarn gripping member itself has improved yarn holding teeth and a greater extension and withdrawal which provides more consistent tuft formation and better machine control and maneuvering. The machine with the improved rear yarn hold also produces a very tight stitch without protruding loops on the back or underside of the backing material. This conserves yarn, enables easier gluing, sizing or rubbering or coating of the back surface of the carpet or rug, as well as improving the texture on the top or exposed side of the completed carpet or rug. Overall, the machine produces highly consistent and uniform loop or cut pile tufts which require little or no finish shearing. In addition, the machine may be easily adjusted for a wider range of lengths of cut or loop pile tufts while repairs and replacement of various parts is simplified. Yarn flow through the machine is better controlled while unexpected yarn withdrawal from the yarn guide areas is prevented. Finally, the machine is more sturdily constructed and includes a better lubrication system to provide more durability in operation, better control for either straight line or design tufting, as well as longer life and more maintenance free operation.

These and other objects, advantages, purposes and features of the invention will become more apparent from a study of the following description taken in conjunction with the drawings.

BRIEF DESCRIPTION OF THE DRAWINGS

FIG. 4 is a fragmentary, top view of the improved tufting machine of FIGS. 1–3;

FIG. 7 is a sectional, end elevation of the lubrication passageways in the rigid support arm taken along line VII—VII of FIG. 2;

FIG. 8 is an end view of the foot, needle, plunger, cutting blade, and yarn gripping member at the free end of the rigid support arm of the tufting machine of FIGS. 1–4;

FIG. 8A is a fragmentary plan view of the gripping end of the yarn gripping member taken along line VIIIA—VIIIA of FIG. 8;

FIG. 8B is a fragmentary, sectional side elevation of the gripping end of the yarn gripping member taken along line VIIIB—VIIIB of FIG. 8A;

FIG. 9 is a fragmentary, perspective view of the inside of the support arm and slide members for the plunger and cutting blades along with the improved cutting blade holding block and its attachment to the cutting blade slide member;

DESCRIPTION OF THE PREFERRED EMBODIMENTS

Figure 1:
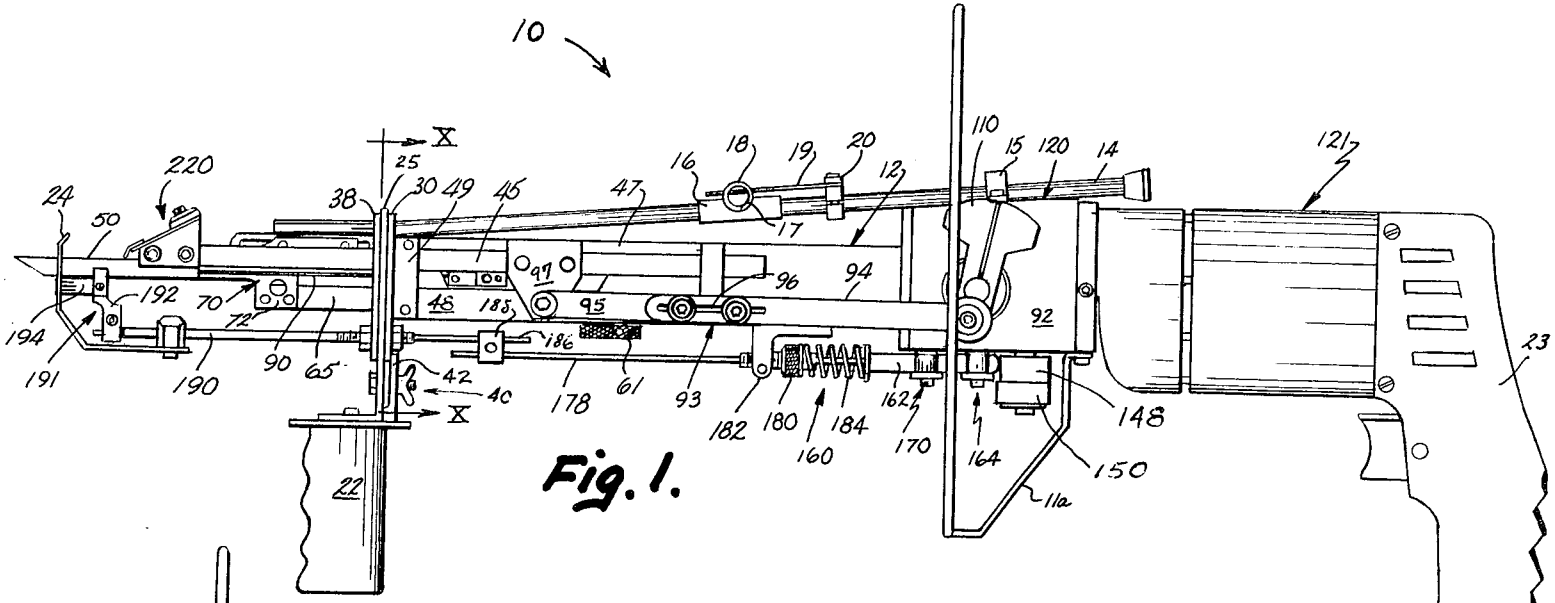
FIG. 1 is a side elevation of the improved tufting machine of the present invention.

Referring now to the drawings in greater detail, FIGS. 1–4 illustrate a first embodiment of the improved, hand held, power driven tufting machine 10 of the present invention. The improved machine includes an elongated, solid, rigid support arm 12 including a plurality of elongated, rigid slide bars 45, 65, 85 slidably mounted thereon and supporting a needle 50, a plunger 70, and a cutting blade 90 (FIGS. 8 and 11) rigidly secured to the individual slide bars. The slide bars with the attached needle, plunger and cutting blade are reciprocably driven by a drive and pivot crank assembly 120 powered by a conventional, variable speed drill motor 121. During formation of the successive loops of yarn from the continuous strand or strands of yarn by means of the needle, plunger and cutting blade, the yarn at the base of the loop previously formed is held by the positively actuated yarn holding assembly 191 on the rear or trailing side of the needle, while the yarn on the other side of the needle is clamped and held by a yarn latch assembly 220 during cutting of the formed loop. The rear yarn hold assembly 191 is actuated by a reciprocating mechanism 160 or 200 driven by a cam 148 (FIGS. 1–3, 5, 5A and 17A). Generally, the basic form of the machine is similar to that shown in my previous U.S. Pat. No. 4,132,182, the disclosure of which is hereby incorporated by reference. However, significant improvements are included which, together with the basic arrangement of the machine, form the subject matter of the present invention.

Figure 2:
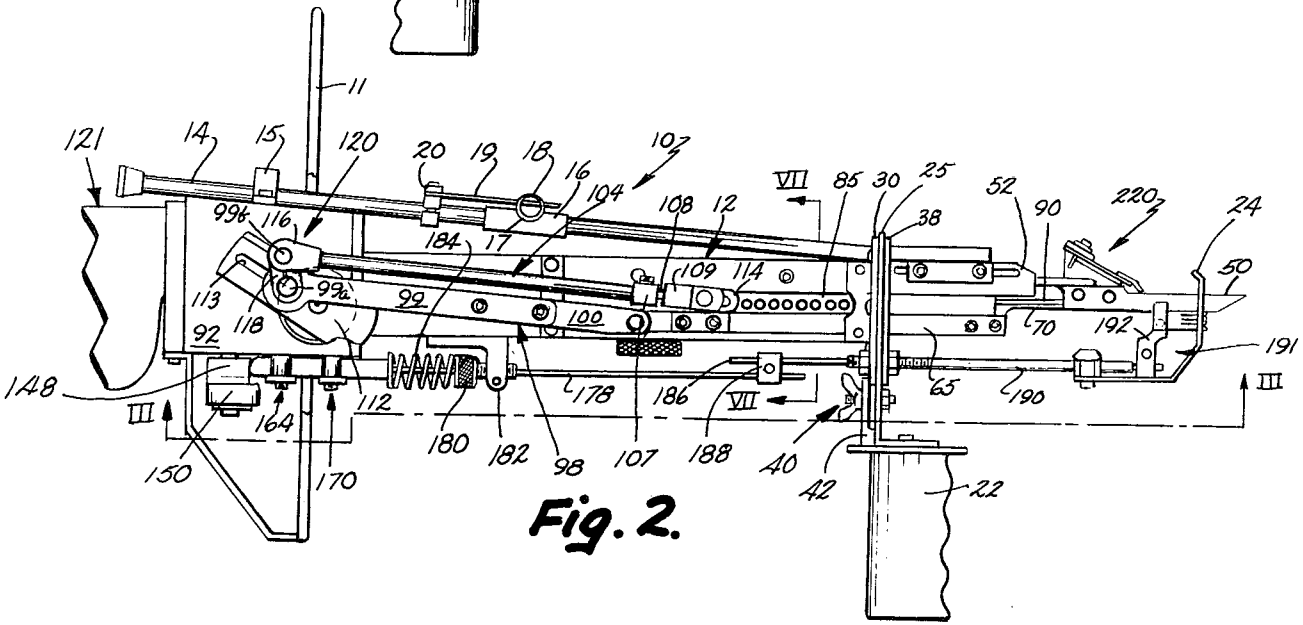
FIG. 2 is a fragmentary, side elevation of the improved tufting machine shown in FIG. 1 taken from the side opposite that of FIG. 1.

Machine 10 is adapted to be suspended from an overhead support by means of a support ring 11 (FIGS. 1 and 2) welded to a downwardly extending ring support arm 11*a* having a flange bolted to the bottom of gear box 92 in the drive and pivot crank assembly 120. A support roller of the type shown in U.S. Pat. No. 4,132,282 may be used to support the machine via ring 11 to allow pivotal rotation about the center of ring 11 and the center line of the machine. Such a support roller may also include an eyelet or hook for guiding yarn from an overhead yarn spool or rack into yarn guide tube 14. Yarn guide tube 14 is a hollow, metallic tube clamped to the inclined top surface of gear housing 92 by means of clamp lock 15 (FIGS. 1–3, 5 and 15). Yarn tube 14 also incorporates a yarn retaining or engaging mechanism including tubular section 16 having a semicircular recess or relieved portion 17 opening into the hollow interior of the tube (FIGS. 1 and 2). A circular, tubular, yarn engaging member 18 having an exterior surface corresponding in shape to recess 17 is received in recess 17 and urged toward the bottom of tubular section 16 by means of a leaf spring biasing member 19. Leaf spring 19 is supported and held by a clamp-type holding member 20 around the exterior of tube 14 and includes a slot for receiving the spring. In order to obtain greater or lesser resistance to movement of the yarn through tube 14, clamp-type holding member 20 can be moved toward or away from tube section 16 and yarn engaging tube 18 to vary the spring resistance force of leaf spring 19. When yarn is received through tube 14 and under yarn engaging member 18, the yarn will be clamped or pinched against the bottom of tube section 16 to prevent its withdrawal from the tube 14 and the other yarn controlling elements including needle 30 and yarn latch 220 described below. This prevents the necessity of rethreading of the yarn through the machine when the machine is moved from area to area around a backing during the tufting operations.

In addition to support ring 11, tufting machine 10 is supported by an operator who grasps a swivel handle 22 mounted for rotation about rigid support arm 12 near the free end of the arm and handle 23 of drill motor 121 as shown in FIGS. 1 and 2. The swivel handle is rotatably mounted coaxially with support ring 11. A backing engaging support foot 24 is clamped and secured to the underside of the forward or free end of support arm 12 by means of a hollow connecting or support tube 190. Foot 24 provides support for the machine against the woven or other backing material or fabric in which the loop or cut pile tufts are to be formed.

Generally, tufting machine 10 is designed for use by an operator standing adjacent a vertically oriented sheet of backing material which is preferably woven and stretched vertically on a frame such that it is taut. The generally horizontally supported machine may be then run along the vertical plane of the material and rotated about the common axis of support ring 11 and handle 22 while being guided by that handle and the handle 23 of drill motor 121. Since the tufting machine is normally advanced toward the side on which needle 50 is located, that area of the machine which also includes yarn tube 14 is generally referred to as the top, front or leading edge of the machine while the opposite side is the bottom, rear or trailing portion of the machine. The crank assemblies and slide assemblies on support arm 12 are on opposing sides of the machine intermediate the top and bottom or front and rear or leading and trailing edges of the machine.

Figure 10:
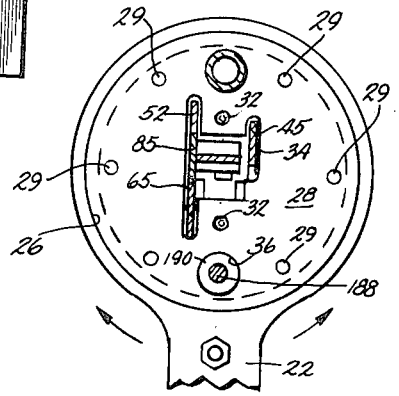
FIG. 10 is a fragmentary, sectional end view of the swivel handle support at the front of the rigid support arm taken along line X—X of FIG. 1.

As is best seen in FIGS. 1, 2 and 10, swivel handle 22 includes a circular ring 25 integral therewith having a large, central circular aperture 26 rotatably mounted around a slightly smaller circular central plate 28 and against a circular retaining plate 30. Plates 28 and 30 are bolted to the outer end surface of support arm 12 by bolts 32 and include aligned generally H-shaped cutouts 34 through which slide bars 45, 65 and 85 extend along with guide bar 52 (FIGS. 2 and 10). The central portion of cutout 34 is large enough to allow the reciprocating motion of rectangular cutting blade securing block 86 to move therethrough when rigidly secured to the inside surface of slide bar 85. In addition, a circular opening 36 is provided in the lower portion of plate 82 through which support tube 190 passes to support foot 24 as well as the reciprocating, internally telescoped, connecting rod 188 for moving yarn gripping member 192 as described below. A second circular retaining plate 38 is bolted against the outer surface of plate 28 by screws 29 extending through plates 30, 25 and 38 and also includes a cutout allowing passage therethrough of the slide and guide bars. Aligned apertures through each of the plates allow passage of yarn guide tube 14 to a position adjacent the operating mechanisms at the end of the support arm 12. The diameters of plates 30 and 38 are equivalent and larger than the diameter of plate 28 and the inner diameter 26 of ring 25 on swivel handle 22. Accordingly, handle 22 is pivotally and swivelly mounted about the end of support arm 12.

In addition, swivel handle 22 includes a clamping mechanism 40 enabling the handle to be secured in a desired position for support of the tufting machine. Clamping mechanism 40 includes a generally L-shaped clamping member 42 (FIGS. 1 and 2) secured between handle 22 and retaining plate 30. Clamp 42 is retained against the outer peripheral portions of retaining plate 30 by a screw passing through handle 22 and member 42 and retained by a wing nut or the like. The shorter leg of member 42 is sufficiently long to enable the longer leg to fit over the marginal edge of retaining disc 30 and yet be clamped against the handle 22. Accordingly, handle 22 is moved to the desired rotational position for comfort of the operator and tightened with clamp apparatus 40 to retain the handle in that position.

As is best seen in FIGS. 1–4, 7 and 9, the rigid support arm 12 has a rectangular cross section when viewed transversely to its elongated direction. One end surface is bolted to the needle facing side of gear box 92 with mounting plate 13 and screws 13*a*, 13*b* (FIG. 5). Elongated, rigid, slide bars 45, 66 and 85 are slidingly mounted in engagement with the opposite side surfaces of support arm 12 as shown in FIGS. 1, 2, 7 and 9. Slide bar 45, on which needle 50 is secured at its outer end, slidably engages surface 46 of support arm 12 and is slidingly confined and supported by stationary guide bars 47, 48 and a pair of spaced, retaining straps or bars 49 bolted through guide bars 47, 48 to bar 12. Slide bars 65 and 85, to which plunger 70 and cutting blade 90 are respectively secured at the ends thereof, are slidably supported against the opposite side 51 of bar 12 by means of stationary guide bars 52, 53 retained in place by spaced, retaining straps or bars 54 bolted through bars 52, 53 to bar 12. Support arm 12 is preferably formed from aluminum to reduce the weight of the machine while slide bars 45, 65 and 75, guide bars 47, 48, 52 and 53, and retaining straps 49, 54 are all formed from oil hardened, tool steel to reduce wear and ground and polished for smoothness.

As is best seen in FIG. 7, lubrication passageways are provided internally of support bar 12 including a main lubrication passageway 55 having branches 55*a*, 55*b* and 55*c* leading to slide bars 45, 65 and 85 respectively at a location along the bar intermediate gear housing 92 and swivel handle 22. Oil or other lubricant is inserted within passageway 55, and thus to the respective branches and the sliding surfaces of the slide bars against support bar 12, by means of a lubrication fitting or closure 56 including a post 57 pressed into arm 12 and having a head or flange 58 and an intermediate diameter portion 59 received in a recess in the bottom of support arm 12. A rotatable collar or washer 61 having a spacing flange 60 is telescoped over post portion 59 for rotation and includes a circular passageway 62 which is designed to communicate with an L-shaped passage 63 extending downwardly through post 57 and into communication with passageway 62 in collar 61. When passageway 62 is aligned with passageway 63 by rotation of collar 61, oil or other lubricant may be inserted into the passageways 55. Collar 61 may then be rotated to close off passageway 63 and prevent escape of the lubricant.

Figure 11:
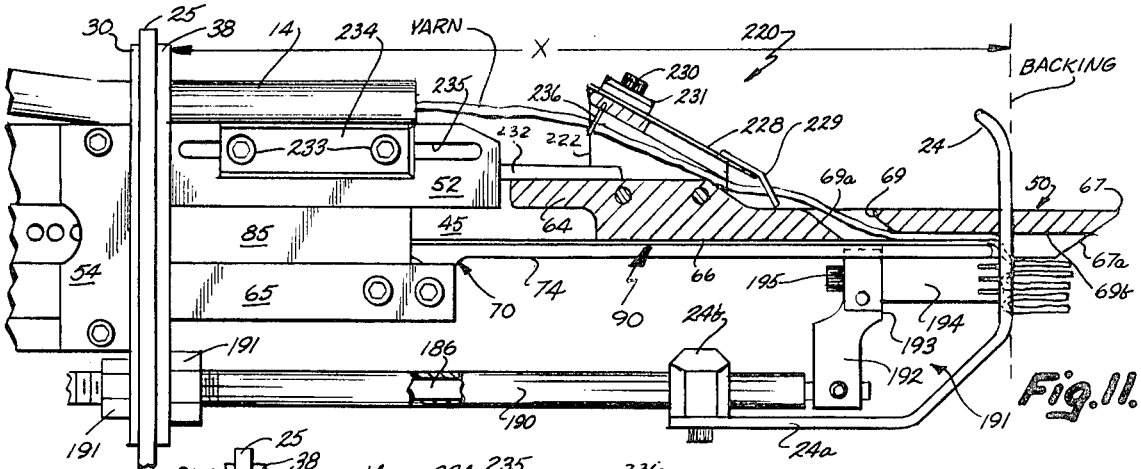
FIG. 11 is a fragmentary, side elevation shown partially in section of the needle, plunger and cutting blade arrangement together with the rear and front yarn hold mechanism shown at an early stage of a loop forming and cutting cycle.

Referring now to FIGS. 1, 2 and 11–14, needle 50 and plunger 70 are of the same configuration as described in U.S. Pat. 4,132,182. Needle 50 is bolted to the inside surface of slide bar 45 at its outer end by means of an upstanding flange 64 projecting from the generally closed side of the needle (FIGS. 2 and 11). The open side 66 of needle 50 extends in an opposite direction from flange 64. Bolted to the inside surface of the outer end of slide bar 65 is plunger 70 by means of the downwardly extending flange 72 on plunger 70 (FIG. 1). Rectilinear plunger shaft 74 (FIG. 11) extends outwardly and is received within the open channel formed by sides 50*a* and 50*b* of needle 50 (see FIG. 8).

As is best seen in FIG. 9, cutting blade 90 is rigidly secured and bolted to the outer end of the inner surface of slide bar 85 by means of a generally L-shaped cutting blade support block 86. Block 86 includes a slotted end 87 with a cross slot extending therethrough towards slide bar 85 for receiving and clamping the rectangular end of blade 90 by means of a cap screw 87*a* passing through the block near the end of blade 90. An extending securing flange 88 projects toward the gear housing from end 87 and includes a pair of spaced apertures 89 which, in the preferred embodiment, are spaced on centers 0.150 inches apart. By means of a bolt passing through one of the apertures 89 and one of a series of securing apertures 89*a* in the cutting blade slide bar, flange 88 secures clamping block 86 to the inside surface of cutting blade slide bar 85. An elongated recess (FIG. 9) within support arm 12 provides space for reciprocation of support block 86. Apertures 89*a* are spaced on centers 0.225 inches apart in the preferred embodiment. Accordingly, by using one or the other apertures 89 in flange 88 and one of the apertures 89*a* in the cutting blade slide bar 85, a wide range of positions for blade 90 can be obtained with the minimal adjustment distance in the preferred embodiment for block 86 being 0.075 inches. The preferred tufting machine provides a range of loop or cut pile from $\frac{1}{4}$ to $1\frac{3}{4}$ inches. The cutting blade clamp block securing arrangement allows the full $1\frac{3}{4}$ inch loop or cut pile to be made without block 86 engaging any portion of the support arm or slide bar support arrangement.

As is best seen in FIGS. 8 and 11, the elongated portion of cutting blade 90 is slidably received between a rectangular guide surface 66 on the interior of needle 50 (FIG. 11) and the top surface of plunger shift 74. These surfaces slidingly support and sandwich the cutting blade. When so secured, needle 50, plunger 70 and cutting blade 90 are all vertically aligned with one another and support arm 12 between sides 50*a*, 50*b* of needle 50 as shown in FIGS. 1, 2, 8 and 11. This nesting of the cutting blade and plunger within the channel-like needle provides effective support for these elements without the necessity of any clamping or spring biasing force applied externally thereon while the rigid attachment of each of these elements to their respective slide bars provides a durable, long wearing assembly during operation.

Referring now to FIGS. 4 and 11, needle 50 includes a pointed outer end 67 formed by sloping, planar penetrating surfaces 67*a*, 67*b* along the closed side of the needle forming a central ridge 68 therealong. These surfaces are preferably at 90° to one another and angle toward the tip 67 at the front as do the flanges below the tip. A yarn entrance opening 69 is provided through the closed side of the needle with a guide surface 69*a* leading to that opening. The inner surface 69*b* of the tip portion of the needle is offset from surface 66 to provide a yarn receiving space within the needle (FIG. 11). The width of the needle between flanges 50*a* and 50*b* and the yarn receiving space within the needle as well as the opening 69 are sufficient to handle multiple strands of yarn typically up to four strands at a time. The rear of the flange 64 extends outwardly and has a top surface providing a sliding surface which contacts the underside of a fixed yarn clamp support 232 bolted to the outer end and inside surface of guide bar 52 which extends through circular retaining disc 30, 38 as described above. A pair of apertures are provided in flange 64 for bolting the needle to the end of its slide bar 45. The strands of yarn fed through the needle may be of one or more colors to provide for desired decorative effects in the rugs produced. The thickness of the needle between ridge 68 and the bottom of flanges 50*a*, 50*b* provides a sufficient opening through which the plunger and cutting blade can be inserted through the backing material in which the tufts are inserted. Further, sloped edges 67*a*, 67*b* leading to the tip 67 facilitate advancement of the machine along the backing by urging the machine with a camming action along the backing as the tip is inserted in a fresh portion of the backing. This movement may be facilitated by a transverse motion produced by allowing lateral movement of slide bar 45 and guide bar 48 as described in U.S. Pat. No. 4,132,182.

As shown in FIGS. 1 and 11, shaft 74 of plunger 70 includes a rounded, contoured, recessed end which allows the yarn to easily roll thereover and therearound without resistance as the plunger pushes the yarn through the opening formed by needle 50 during operation of the machine. A pair of apertures is provided for bolting the plunger to slide bar 65.

As shown in FIG. 9, cutting blade 90 includes a thin elongated blade portion secured to cutting blade support block 86. The outer end of the cutting blade includes a sharpened, V-shaped, recess or notch. The inner edges of notch 91 are preferably 60° to one another and are sharpened by beveling the blade from the top surface (FIG. 11). Preferably, the cutting blade is formed from a flexible, resilient, spring-like steel which is sufficiently hard to retain a sharp edge at notch 91. Buffing with a buffing wheel is usually sufficient to renew the sharpness of the edge of the V-shaped notch.

Referring again to FIGS. 1–4, each of the slide bars 45, 65, 85 is driven by its own connecting arm pivotally secured between the respective slide bar and one of the rotating cranks 110, 112 on opposite sides of gear box 92. Cranks 110, 112 are generally T-shaped on one end to counterbalance slotted extensions and connecting arms mounted on their other ends. The T-shaped end of crank 110 is split and received over the extending end of gear shaft 132 (FIGS. 1 and 5). The split end is drawn together with a bolt through the crank to fix the crank on the rotatable shaft. Crank 112 is threaded on the reduced diameter, opposite end of shaft 132.

Needle slide bar 45 is reciprocated by connecting arm 93 including a rectilinear arm portion 94 and an offset arm portion 95 secured to the outer end of portion 94. Arm portion 94 includes an elongated slot 96 through which a pair of bolts extend to secure portion 95 thereto while allowing adjustment of the position and length of arm 93 to change the position and extension of slide bar 45 and needle 50. Connecting arm 93 is pivotally connected to slide bar 45 by a pivot bracket 97 bolted to the exterior side of slide bar 45 and having a downwardly extending flange from which a pivot post extends outwardly for connection to arm portion 95. The apertured end of arm portion 95 is bolted over the reduced diameter portion of the pivot post to provide the pivot connection as is explained in U.S. Pat. No. 4,132,182. The opposite end of connecting arm 93 is pivotally secured to crank 110 by a pivot post secured in the crank and extending through the apertured end of arm portion 94 also as in U.S. Pat. No. 4,132,182.

The cutting blade and plunger slide bars 85 and 65, respectively, are each pivotally connected to crank 112 on the opposite side of gear box 92 from crank 100 by connecting arms similar to arm 93. Plunger connecting arm 98 includes a rectilinear portion 99 and an offset portion 100 which are bolted together in a manner similar to arm 93 except that no elongated slot is provided for adjustment purposes. The outer end of arm 98 is pivotally secured to a pivot post extending outwardly from a securing member 102 which is bolted to the exterior side of slide bar 65 as in U.S. Pat. No. 4,132,182.

Connecting arm 104 for the cutting blade slide bar is slightly different and adapted for easier adjustment than the corresponding arm in U.S. Pat. No. 4,132,182 to provide fine adjustment in the length to which the cutting blade 90 is extended for cutting purposes. Connecting arm 104 includes a hollow, tubular, rectilinear arm portion 106 in which is telescoped a solid circular rod 108. A clamping member 107 is fitted on the diametrically slotted end of arm portion 106 which receives rod 108 to clamp the rod in place at the desired position along tube 106. Rod 108 is fixedly secured to an L-shaped pivot member 109 having a flange received over a pivot post **109*a* extending outwardly from a rigid connecting member 114 extending outwardly from the exterior side surface of cutting blade slide bar 85 (FIG. 4). A set screw 115 secures the pivot post 109*a* within member 114. The opposite end of arm 104 includes a pivot member 116 secured to the end of tube 106 and pivotally received over a pivot 99*b* (FIG. 2) extending outwardly from a slotted clamp-type connecting member 118. Connecting member 118 is fixedly secured by a set screw on the outer end of pivot post 99*a*, which secures arm portion 99 to crank 112, such that the angular relationship between the slotted end of crank 112 and member 118 remains the same. In the preferred embodiment, member 118 extends at 30° to the center line extending through the slot 113 of crank 112. By clamping the pivot post 99*a* along slot 113 in a desired position, the amount of reciprocation of both the cutting blade and plunger via slide bars 65, 85 and the connecting arms 98, 104 is controlled. That is, greater extension is obtained by clamping post 99*a* toward the outer end of slot 113 than when it is secured toward the inner end of that slot. The securing apparatus for post 99*a* is the same as that shown for the corresponding pivot post in U.S. Pat. No. 4,132,182. Changing the position of connecting member 118 with respect to crank 112 changes the timing of the extension of the cutting blade with respect to the extension of the plunger providing one method of adjustment to change from cut pile loop formation to simple loop formation with the machine. Alternately, the cutting blade is simply removed from block 86** to form loop pile tufts.

The position of the cutting blade 90 with respect to the position of plunger 70 may be adjusted by changing the position of the connecting arm portion 106 with respect to arm portion 108. This does not change the timing of the cutting blade and plunger extension. Further, cutting blade securing block 86 may be moved along the inside surface of cutting blade slide bar 85 and bolted in a different position via apertures **89*a*. Moving block 86 also changes the position of cutting blade 90 without effecting the timed relationship between the cutting blade and plunger as does the rotation of clamping block 118**.

Figure 6:
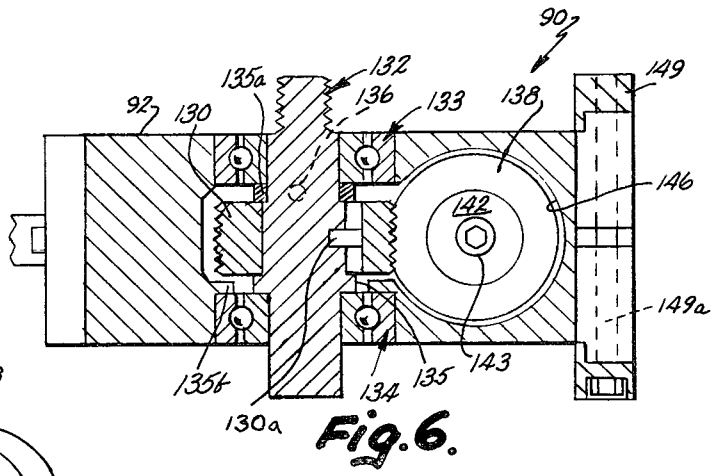
FIG. 6 is a fragmentary, sectional top plan view of the gear housing and drive gears taken along line VI—VI of FIG. 5.

Referring now to FIGS. 5 and 6, the spiral or helical gear drive mechanism 120 within housing 92 for rotating cranks 110 and 112 as well as for providing a rotating cam to reciprocate the rear yarn hold 191 is shown. A rotating drive shaft 122 extending from drill motor 121 and having a tapered end 123 is secured within rotatable coupling shaft 124 within a bore 125 which is parallel to support arm 12. Drill motor 121 is held on housing 92 by split back plate 149 including screw **149*a* (FIG. 5) to clamp the motor in the opening provided in the back plate. Shaft 124 is connected via a set screw to a gear support shaft 126 which has a reduced diameter portion receiving needle bearing 127 and abutting against a thrust bearing 128 at the front of the gear box. An intermediate diameter portion of shaft 126 supports a helical gear 129 telescoped thereover and fixedly pinned to the shaft by pin 129*a***.

Helical gear 129 engages another helical gear 130 supported on a stepped portion of a transversely mounted drive shaft 132 which rotates at right angles to gear 129. Rotation of gear 130 is prevented by pin **130*a*. Shaft 132 is supported by bearings 133, 134 (FIG. 6) spaced from the portion of shaft 132 which supports gear 130 by an integral flange 135 on shaft 132, a collar 135*a* telescoped over shaft 132, and by a flange 135*b* within the housing 92. Bearings 133, 134 are press fitted into openings on each side of the housing 92. A retaining screw 136 is received such that it projects beyond the outer periphery of bearing 133 interior or the bearing to retain it in place and to prevent it from shifting. Accordingly, rotation of drive shaft 122 of drill motor 121 in turn rotates helical gears 129 and 130 to rotate shaft 132 and cranks 110 and 112** fixed on opposite extending ends of that shaft.

In order to operate the rear yarn hold mechanism 191, a third rotating shaft rotated by helical gear 138 is provided. Gear 138 engages gear 130 and is pinned by pin **138*a* to a reduced diameter portion of a rotatable shaft 140 whose axis extends at right angles to the axes of rotation of both shafts 126 and 132. Gear 138 is retained on the reduced diameter portion of shaft 140 against flange 140*a* by the washer 142 and cap screw 143. Another reduced diameter portion of shaft 140 on the opposite side of flange 140*a* is received in a pair of ball bearing units 144, 145 which are press fitted within a bore 146 in gear housing 92 which extends at a right angle to and communicates with bore 125 receiving shaft 126** and the recess receiving transverse drive shaft 132. A screw 147 which is received through an opening in the backplate which provides a mounting for drill motor 121 at the end surface of the housing 92 extends into bore 146 and provides a stop against which the bearing 144 and 145 are abutted. Threaded plug 158, opposite bearings 144, 145, is removable for lubrication of the gear housing and to admit a probe to expel those bearings for maintenance. A further reduced diameter end portion 140*b* of shaft 140 extends out of the bottom side of the gear housing 92 and receives thereover an irregularly shaped cam member 148 and a retaining collar 150 thereover.

Figure 5A:
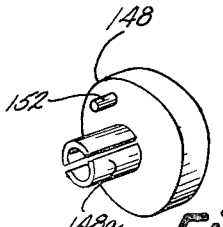
FIG. 5A is a perspective view of the cam for the yarn gripping member.
Figure 5:
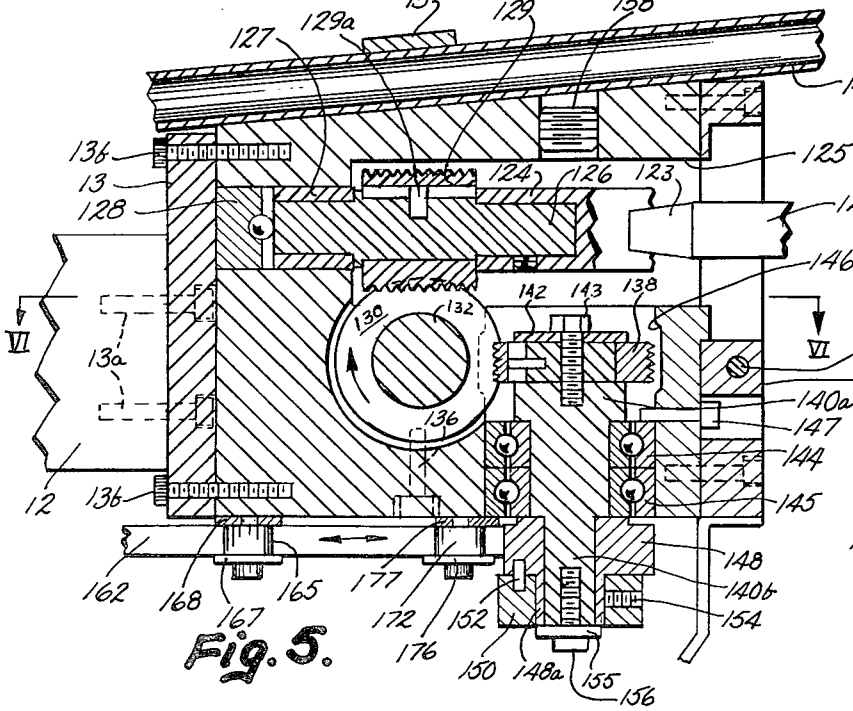
FIG. 5 is a sectional, fragmentary, side elevation of the gear housing, drive gears and camming apparatus for the yarn gripping member of the improved tufting machine taken along plane V—V of FIG. 3.

As shown in FIG. 5A, cam 148 includes an extending cylindrical flange 148*a* which is split at diametrically opposed locations and includes a central bore sized to receive shaft end 140*b*. Retaining collar 150 includes a central bore telescoped over the extending flange of cam 148 and is pinned to cam 148 via pin 152. A set screw 154 in collar 150 clamps flange 148*a* against shaft portion 140*b* to retain both the collar 150 and cam 148 in position on shaft 140*b*. A washer 155 and cap screw 156 complete the assembly and retain the cam and collar assembly against the inner race of bearing 145. Accordingly, rotation of shaft 140 by means of gear 138 driven by gear 130 rotates cam 148 continuously to drive the reciprocating mechanism of the rear yarn hold 191 as described below.

Figure 3:
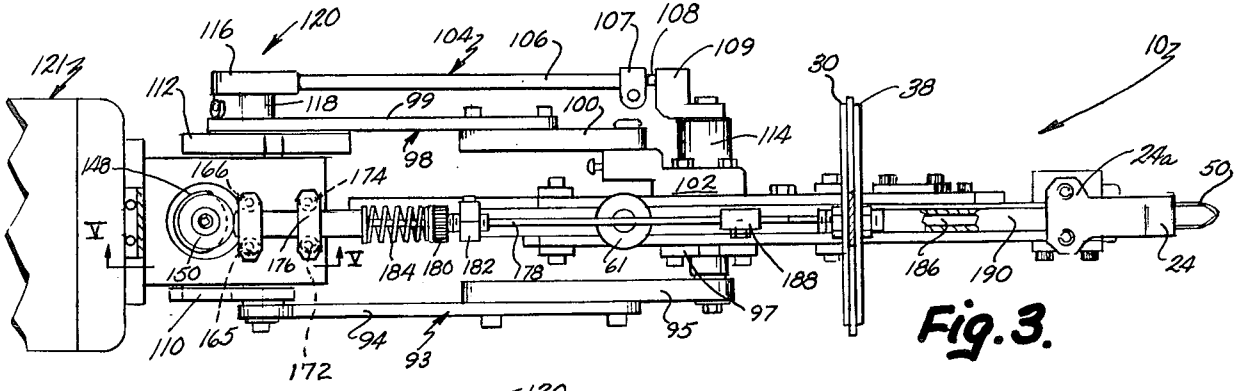
FIG. 3 is a fragmentary, bottom view of the improved tufting machine taken along line III—III of FIG. 2.

As is best seen in FIGS. 1–3, 5 and 11–14, the rear yarn hold assembly is operated in the preferred embodiment by a reciprocating mechanism 160 mounted along the bottom or trailing edge of rigid support arm 12 opposite to yarn tube 14. Reciprocating mechanism 160 includes rectilinear, rigid cam follower 162 retained for sliding reciprocal movement between two spaced pair of opposing, rotatable bearings 164, 170. Bearing unit 164 includes circular bearings 165, 166 on opposite sides of the cam follower 162 retained in place between a covering retaining plate 167 and a support plate 168 next to the side surface of housing 92. Similarly, bearing unit 170 includes bearings 172, 174 on opposite sides of cam follower 162 retained by a retaining plate 176 and support plate 178. Plate 178 is positioned such that one edge thereof extends slightly over the outer race of bearing 145 to retain bearings 144, 145 in place against screw 147 in bore 146. Because cam 148 rotates clockwise as shown in FIG. 3, bearings 165, 174 bear a lateral thrust exerted on the cam follower and urging it with greater force against those two bearings than with respect to bearings 166, 172. Accordingly, bearings 165, 174 are roller bearing units while bearings 166, 172 are journal bearings.

Extending toward the free end of support arm 12 from cam follower 162 is a connecting rod 178 telescoped through a threaded abutment fitting 180. Fitting 180 is threaded into the outwardly extending flange of a support member 182 secured to the underside of arm 12. A coil spring extends between abutment member 180 and a fitting on the end of cam follower 162 and urges that cam follower toward and into engagement with cam member 148 at all times. Connecting rod 178 is secured to a second, offset connecting rod 186 by means of an adjustable clamping member 188. Connecting rod 186 is slidably telescoped through a rigid, hollow, right cylindrical tube 190. The end of tube 190 closest to the drill motor 121 extends through aperture 36 in the mounting apparatus for swivel handle 22 as shown in FIG. 10. Securing nuts 191 are tightened on either side of retaining discs 30, 38 to hold tube 190 in place. Connecting rod 186 extends beyond the free end of tube 190 and is secured to a support 192 for yarn gripping member 194. Support 192 is telescoped over the free end of connecting rod 186, and fastened with a set screw, and has an outwardly facing surface 193 parallel to foot 24 to which is secured the yarn gripping member 194 by means of a retaining screw 195. Fastened to either side of support 192 at right angles to surface 193 are guide plates 197 secured by a bolt passing through member 192. Plates 197 extend above the surface of member 192 which is flush with the side of yarn gripping member 194 closest to needle 50 to confine sides 50*a*, 50*b* of the needle between those plates and guide the reciprocal movement of the yarn gripping member.

Foot 24 includes an extending leg 24*a* (FIG. 11) which extends parallel to tube 190 and provides support for the foot by means of a U-shaped clamping block 24*b* secured by a pair of screws over tube 190. Accordingly, tube 190 both supports foot 24 which, in turn, supports the tufting machine 10 against the backing into which the yarn is being inserted, as well as provides a support and guide for the reciprocating rear yarn hold gripping member 194.

Yarn gripping member 194 as shown in FIGS. 8, 8A and 8B includes multiple rows each including a series of teeth 195 extending outwardly from the end of member 194. Each tooth has a series of inclined surfaces leading to an apex or point 196. The combined series of points 196 securely retain previously formed loops against the backing material during formation of new loops or cut pile tufts as shown in FIGS. 11–14. As shown in FIGS. 8B and 11–14, one surface of each tooth 195 is inclined toward needle 50 when the gripping member is in place. Such inclination facilitates movement of the tufter in the direction of the needle and the curved end of foot 24 along the backing while the rectilinear surface on the opposite side of each tooth, in combination with the point 196, helps prevent pulling of previously formed loops in that same direction. Accordingly, the teeth both facilitate movement of the machine while more securely retaining previously formed loops or tufts in the backing. When member 194 is extended in the preferred embodiment, teeth 195 project past foot 24 approximately $\frac{1}{8}$ inch.

Figure 15:
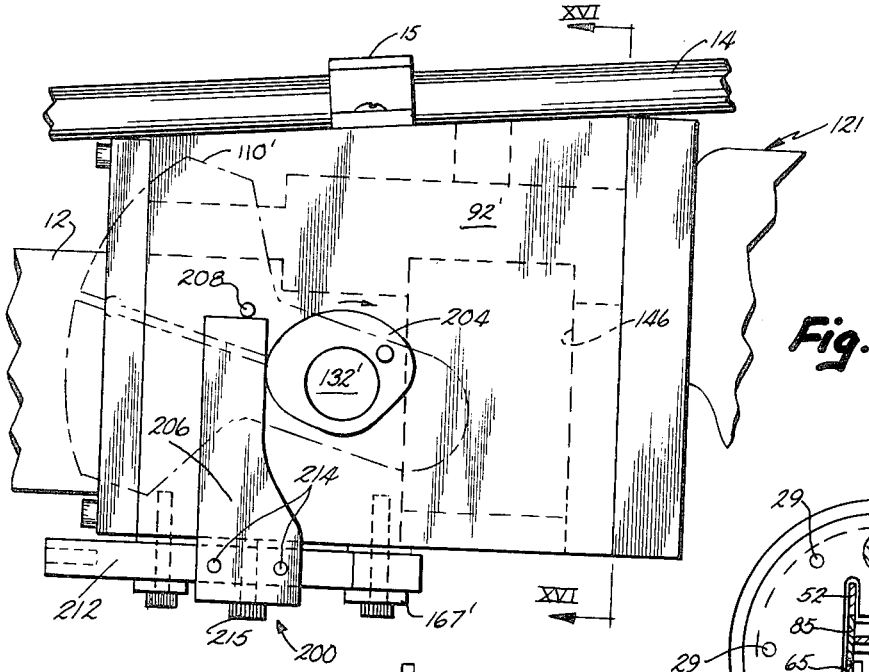
FIG. 15 is a fragmentary, side elevation of another embodiment of the improved tufting machine including a modified yarn gripping member camming mechanism.
Figure 17A:
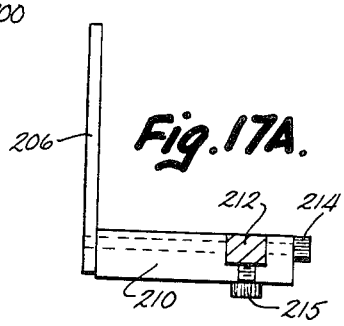
FIG. 17A is an end elevation of the modified cam follower and connecting member of FIGS. 15–17.
Figure 16:
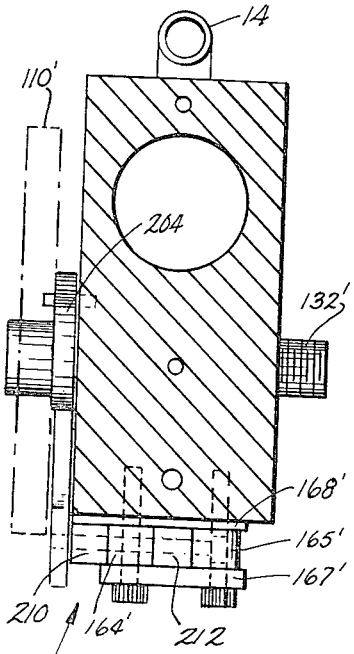
FIG. 16 is a back elevation of the drive housing of the tufting machine embodiment of FIG. 15.
Figure 17:
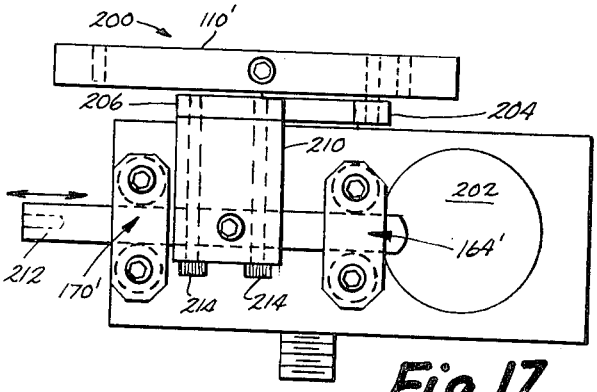
FIG. 17 is a bottom view of the drive housing and modified camming mechanism of FIGS. 15 and 16.

An alternate camming assembly 200 for reciprocating the yarn gripping member 194 is shown in FIGS. 15–17. In embodiment 200, drive shaft 140 is eliminated and bore 146 is unused. A circular disc or filler plug 202 is inserted to close that otherwise open bore. In this form, where like parts bear primed numbers corresponding to similar parts in the camming mechanism previously described, a cam member 204 is secured over drive shaft 132′ beneath crank 110′. Cam 204 is pinned to crank 110′ such that the two rotate in unison with the drive shaft 132′. An elongated cam follower 206 extends along the side surface of housing 92′ and includes a rear facing surface 207 which engages the irregularly shaped peripheral surface of cam member 204 at all times. Because cam member 204 rotates in the clockwise direction as shown in FIG. 15, and thus creates an upward thrust on member 206, a thrust bearing pin 208 at the end of member 206 is secured in housing 92′ to resist that rotationally imparted thrust. Cam follower 206 is secured at its lower end to a rectangular connecting member 210 which, in turn, is secured to rectilinear member 212 by means of a pair of connecting screws 214 and a set screw 215 (FIGS. 17 and 17A). Bearing units 164′ and 170′ support rectilinear member 212 in the same manner as cam follower 162 described above. Accordingly, rotational movement of cam 204 simultaneously on drive shaft 132' with crank 110' reciprocates cam follower 206 and thus the yarn gripping member by means of member 212 without the necessity of including a separate drive shaft 140 and support apparatus therefore as in the first embodiment described above. With either reciprocating mechanism 160 or 200, the continuous engagement of cam 148 or 204 with the cam follower allows timing and operation of the yarn gripping member 194 independently of the needle, plunger or cutting blade. This insures better yarn holding and more even tufts. In addition, the camming mechanisms allow greater tufting speed with less vibration.

Figure 11A:
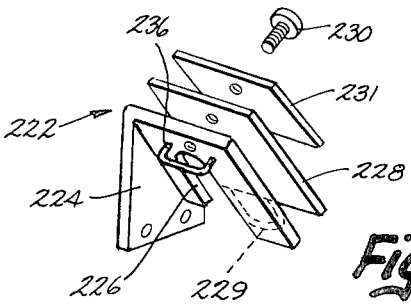
FIG. 11A is a rear perspective view of a portion of the front yarn latch mechanism.

As is best seen in FIGS. 11 and 11A, a second yard hold apparatus 220 on the front or leading edge of needle 50 and opposite to the rear yarn holding apparatus 191 and yarn gripping member 194 is shown. Leading side yarn holder mechanism or yarn latch 220 includes an upstanding, generally triangular channel member 222 having one downwardly extending side flange 224 bolted to a side surface of flange 64 of needle 50 (FIGS. 1, 11 and 11A). The same bolts which secure member 222 to the needle also secure the needle to slide bar 45 as described above. Member 222 includes a U-shaped recess 226 in its upper surface through which the yarn passes as it travels to the needle 50 for insertion through the backing material. A flexible resilient steel spring plate 228 is secured to the sloped front side of channel member 222 by a clamping screw 230 and a clamping plate 231 atop the spring plate. The lower end of plate 228 covers the opening of yarn passage 226 and includes a U-shaped clip 229 (FIGS. 11, 11A and 12–14) secured to the top surface of plate 228 and extending downwardly below the bottom edge of plate 228 to confine and guide the yarn as it passes therethrough. This maintains the position of the yarn for clamping by abutment member 232. A yarn abutment member 232 is secured on the inside surface of stationary guide member 52 by means of a securing plate 234 and a pair of fastening screws 233 extending through an elongated slot 235 in plate 234 allowing adjustment of the position of yarn abutment member 232. Abutment member 232 has a rounded nose of a width smaller than recess 226 such that, as the needle and triangular member 222 are moved rearwardly by means of slide bar 45, the nose of abutment 232 will pass through recess 226 to clamp the strand of yarn against the underside of spring plate 228 to prevent it from being pulled further outwardly through the needle 50 as shown in FIG. 13. Such clamping preferably begins slightly in advance of the farthest extension of cutting blade 90 to account for slight yarn stretching, and continues during the cutting action. In order to help guide the yarn through the latch 220, a U-shaped clip 236 is secured to the underside of the top portion of triangular member 222. Yarn passes through clip 236 and clip 229 to prevent the yarn from moving out of the recess 226 and to better control the yarn flow during operation of the tufting machine.

As will be understood from FIGS. 11–14, yarn latch 220 in only in operation to clamp and prevent further extension of the yarn through the needle 50 when the needle 50 is fully retracted on slide bar 45. This is the same time at which plunger 70 is fully exended and cutting blade 90 is making any cut through the formed loop. Simultaneously, rear yarn grip member 194 is in engagement with the previously formed loops along the backing such that the yarn is tightly and securely prevented from further extension on both sides of the plunger, needle and cutting blade combination. This insures exact uniformity in the length of each loop or cut pile tuft formed by the machine.

Referring now to FIGS. 11–14, the timed operation of the needle, cutting blade, plunger and leading and trailing yarn hold mechanisms as operated by the spiral gear driven crank arms, connecting arms, slide bars and rotating cam will be understood. As least one strand of continuous yarn is fed through yarn guide tube 14, U-shaped clip 236 and yarn passageway 226 is yarn latch 220, U-shaped clip 229, into opening 69 in needle 50, and through the internal yarn passageway of the needle. The yarn passes around the gripping member 194 and its teeth 195 to the previously formed loop or cut pile in the woven backing of fabric as shown in FIG. 11.

The operational cycle begins with needle 50 being extended through the backing material to form an opening therein through which the plunger and cutting blade will later extend. Foot 24 supports the machine against the backing. The operation of gear motor 121 rotates drive gear shaft 132 rotating crank 110 in a clockwise direction (FIG. 1) sliding slide bar 45 and needle 50 through and out the backside of the backing by means of pivotal connecting arm 93. At the point of greatest extension of the needle, the direction of the needle reverses and its retraction is begun by means of that slide bar. At the same time, crank 112 is simultaneously being rotated by shaft 132 on the opposite side of the gear housing 92 to slide plunger slide bar 65 and plunger 70 forwardly such that the rounded, recessed plunger end engages the yarn strand or strands extending across the opening between the yarn gripping member 194 and the needle and pushes the yarn through the opening formed by the needle. Such pushing action pulls the yarn through the yarn guide tube 14, yarn latch 220 and the needle passageway which provides a free, unrestricted passageway for the yarn (FIG. 11). At the same time, rotation of crank 112 also urges slide bar 85 forwardly such that cutting blade 90 is advancing behind the leading edge of the plunger 70. To maintain a proper opening through the backing, the machine should be adjusted such that the curved edges **67*a*, 67*b* of needle 50 are below foot 24 while needle 50 moves upwardly and when plunger 70** has just begun to penetrate the backing on its downward movement.

Figure 12:
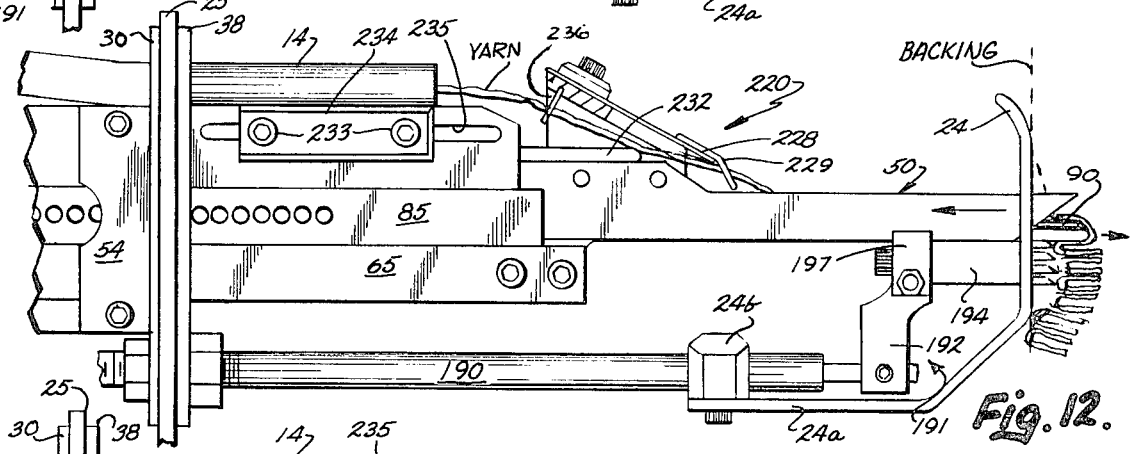
FIG. 12 is a fragmentary, side elevation of the tufting machine similar to FIG. 11 shown at a second stage of the loop forming and cutting cycle.
Figure 13:
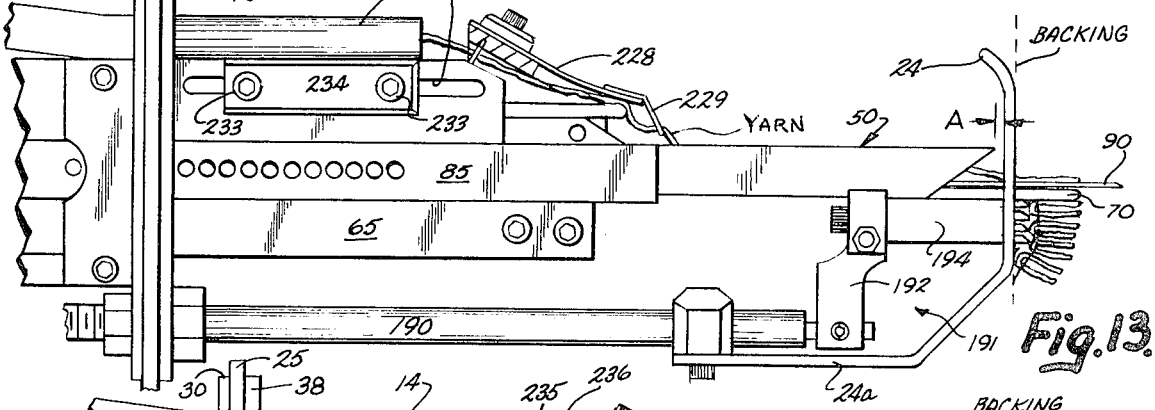
FIG. 13 is a fragmentary, side elevation of the tufting machine similar to FIGS. 11 and 12 shown at a third stage of the loop forming and cutting cycle.
Figure 14:
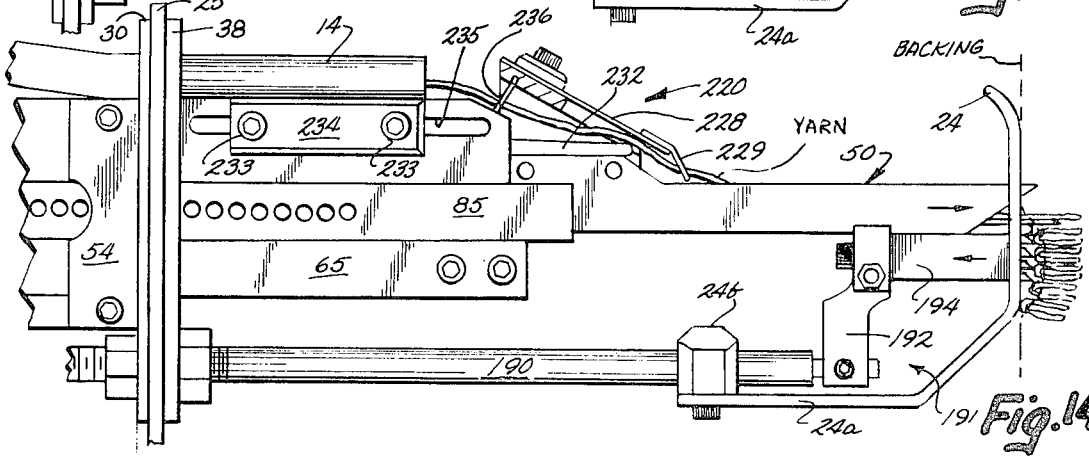
FIG. 14 is a fragmentary, side elevation of the tufting machine similar to FIGS. 11–13 shown at a fourth stage of the loop forming and cutting operation just prior to completion of the cycle.

As the needle 50 is being retracted, and immediately prior to extension of plunger 70, yarn gripping member 194 is extended beyond the backing engaging surface of foot 24 to hold the previously formed loops as shown by comparing FIGS. 11 and 12. Such extension of member 194, which is preferably ⅛ inch, occurs through the connecting rods 178, 186 as moved by cam follower 162 engaging the peripheral camming surface of the cam member 148. The yarn gripping member remains extended as shown in FIGS. 13 and 14 throughout the loop formation and cutting of the loop, as well as during the retraction of the plunger. Yarn gripping member 194 is in its retracted position during the time needle 50 is initially and only slightly projecting through the backing to form a new hole through which the plunger and cutting blade will extend. This allows the tufting machine to move slightly forward as forced by the inclined surfaces **67*a*, 67*b* on the leading edge of the needle which urge the entire machine toward and curved end of foot 24. Thereafter, yarn gripping member 194 is again extended by means of cam 148 or 204** and one of the two reciprocating mechanisms previously described.

As the plunger 70 continues to extend through the backing as shwon in FIG. 12, it reaches its distance of greatest extension. Simultaneously, needle 50 reaches its point of greatest retraction as shown in FIG. 13 causing yarn abutment member 232 to engage spring plate 228 and pinch or clamp the yarn at that point. Together with the gripping of the previously formed loops by member 194, the clamping action of the yarn on the opposite side of the needle by latch 220 prevents both the previously formed loop and the continuous length of yarn from being further extended through the needle. Thus, proper cutting is achieved because the yarn is held from further extension on both sides of the needle and plunger allowing the cutting blade 90 to be extended past the end of the plunger 70 as shown in FIG. 13 to cleanly and neatly sever the yarn at the exact length of the previously formed cut pile tufts. Clamping by latch 220 slightly before cutting by blade 90 is fully extended accounts for any yarn stretch and maintains consistent length tufts. As previously described, if loop pile tufts are desired, the cutting blade 90 can be removed from cutting blade support block 86, or the clamping member 118 or connecting arm 104 can be adjusted to prevent extension of the cutting blade past the end of plunger 70.

After cutting of the formed loop as shown in FIG. 13, the plunger 70 and cutting blade 90 are retracted by further rotation of crank 112 and rearward movement of connecting arms 98, 104. At the same time, needle 50 begins a new stroke for advancement through a new portion of the backing with the inclined surfaces on its leading edge urging the machine toward the curved end of foot 24. Such movement is allowed by the inclined surfaces on the teeth of yarn gripping member 94 immediately prior to its full retraction and during its period of retraction as described above. The connection of cutting blade through connecting member 118 to crank 112 causes the cutting blade to move through a greater distance at the same rotational speed of crank 112 as compared to the movement of plunger 70 which is connected through a connecting pin directly to the crank. Thus, even though the cutting blade is extended farther than the plunger, both are retracted essentially simultaneously, as shown in FIG. 14, with the cutting blade traveling at a slightly faster rate. Adjusting the angle of connecting member 118 with respect to crank 112 to cause cutting blade 90 to rise out of the backing material just before or at least simultaneously with the plunger helps insure proper cutting for consistent, even tufts. After, or at least simultaneously with, full retraction of the plunger and cutting blade, the yarn gripping member 194 is retracted to the position shown in FIG. 11 to begin a new cycle by an appropriate portion of the peripheral surface of cam member 148 or 204.

It has been found that the needle 50 should travel the same distance for all lengths of cut or loop pile tufts formed by the machine to provide proper openings in the backing material. In the preferred embodiment, the distance of travel is $1\frac{1}{8}$ inches from the point of greatest retraction of the needle to the point of greatest extension. In addition, the position of foot 24 from the swivel handle support disc 38 must be properly adjusted to allow the needle, plunger and cutting blade to operate in their proper relationships. It has been found that the height of the needle above the foot at its point of greatest retraction, distance A in FIG. 13, and the distance of the foot from the disc 38, distance X in FIG. 11, should be set in accordance with the following table depending on the length or range of lengths of the cut pile or loop pile tufts to be formed on any given carpet:

| LENGTH OF LOOP OR CUT PILE TO BE FORMED | DISTANCE OF POINT OF NEEDLE ABOVE BACKING MATERIAL (DISTANCE A) | DISTANCE OF FOOT FROM SWIVEL HANDLE RETAINING DISC (DISTANCE X) |
|---|---|---|
| $\frac{1}{4}$ to $\frac{1}{2}$ inch | 1/16 inch | 6 inches |
| 5/16 to $\frac{5}{8}$ inches | 1/16 inch | $5\frac{7}{8}$ inches |
| $\frac{1}{2}$ to $\frac{3}{4}$ inches | $\frac{1}{8}$ inch | $5\frac{3}{4}$ inches |
| $\frac{5}{8}$ to 1 inch | 3/16 inch | $5\frac{5}{8}$ inches |
| $\frac{3}{4}$ to $1\frac{3}{4}$ inches | 3/16 inch | $5\frac{1}{2}$ inches |

The above settings provide the needle and plunger with their proper relationship such that curved edges **67*a*, 67*b* of needle 50 are below the foot as needle 50 moves upwardly when plunger 70 has just begun to penetrate the filler on its downward movement. This provides a properly sized opening through the backing and allows the plunger to push the yarn through without resistance. It has been found that for any foot setting, the machine, and especially plunger 70, may be adjusted to form yarn loops of a length range of zero to one inch approximately while maintaining high quality uniformity of tufting without other adjustments. In addition, these above settings keep the distance of reciprocal movement of the connecting arms and slide bars at a minimum. This, in turn, enables greater speed for the machine and more smoothness with less vibration. In addition, maintenance time is reduced because of the smaller vibration and loosening of the various connections in the machine. The foot height setting is adjusted by loosening the screws on leg 24*a* and moving the clamping block 24*b* along tube 190. Whenever the foot settings X are changed, both needle retraction settings A and the adjustment of the extension of the yarn gripping member 194 should be adjusted. Member 194 is adjusted such that it extends a maximum distance of approximately $\frac{1}{8}$ inch below the foot 24 by adjusting the clamping member 188 with respect to the connecting rods 178 and 186. Needle extension and retraction setting A is adjusted by loosening the screws in slot 96 in connecting arm 93 and moving arm portions 94, 95 with respect to one another. To adjust in the clamping action of the yarn latch 220 after the position of needle 50 and thus channel member 222 have been adjusted, the position of yarn abutment 232 may be changed by loosening the screws which hold plate 234 in the elongated aperture on guide bar 52 and moving abutment 232 such that the yarn will be pinched against spring plate 228 slightly prior to and during the time at which cutting blade 90 is severing the loops formed by plunger 70**.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. In a tufting machine for forming loop or cut pile fabrics including an elongated, rigid support arm; first means on said support arm for engaging a backing material; second means on said support arm for forming successive loop tufts from a continuous length of yarn in the backing material and for cutting said loop tufts when desired; yarn holding means on at least one side of said second means for holding the yarn of at least one previously formed loop against the backing material on said one side of said second means during cutting and/or forming of said loop or cut pile tufts, the improvement comprising:

drive means for operating said second means and said yarn holding means including crank means for operating said second means and camming means for operating said yarn holding means independently of said second means during a predetermined portion of the operation of said second means.

2. The improved tufting machine of claim 1 wherein said yarn holding means include a yarn gripping member and reciprocating means for reciprocating said yarn gripping member into and out of engagement with said yarn and backing material; said camming means including a rotating shaft with a cam surface thereon, said cam surface continuously engaging said reciprocating means to operate said yarn gripping member when said shaft is rotated.

3. The improved tufting machine of claim 2 wherein said drive means include a housing having a series of interengaging gears mounted therein; means for mounting a motor to said housing for operating said gears; crank means connected to said gears for operating said second means; said rotating shaft and cam surface extending from said housing at a position spaced from said crank means.

4. The improved tufting machine of claim 2 wherein said reciprocating means include a cam follower means for engaging said cam surface, an elongated connecting means for connecting said yarn gripping member and cam follower means, means for slidably mounting said connecting means, and biasing means for urging said cam follower into engagement with said cam surface.

5. The improved tufting machine of claim 4 wherein said connecting means include adjustment means for changing the length of said connecting means to control the position of said yarn gripping member.

6. The improved tufting machine of claim 4 wherein said drive means include a housing having a series of interengaging gears mounted therein; said reciprocating means extending along one side of said housing; said rotating shaft and cam surface driven by one of said gears and extending from another side of said housing; means for mounting a motor to said housing for operating said gears; crank means on said rotating shaft for operating said second means; said cam follower means including rigid extension means secured to said elongated connecting means and extending along said housing to a position adjacent to and in contact with said cam surface.

7. The improved tufting machine of claim 4 wherein said support arm includes a free end; said means for slidably mounting said connecting means include a hollow tube secured adjacent said free end of said support arm; said connecting means including an elongated connecting member slidably telescoped through said hollow tube; said first means including a foot for engaging the backing material and means for securing said foot to the exterior of said hollow tube.

8. The improved tufting machine of claim 4 wherein said means for slidably mounting said connecting means include thrust bearing means for bearing the lateral thrust imparted to said cam follower by said rotating cam surface.

9. The improved tufting machine of claim 2 wherein said yarn holding means include guide means engaging said second means for guiding movement of said yarn gripping member.

10. The improved tufting machine of claim 2 wherein said yarn gripping member includes a plurality of elongated, parallel teeth projecting therefrom for engagement with the backing material and yarn, said teeth being arranged in rows, each tooth having inclined surfaces converging to a point.

11. The improved tufting machine of claim 1 wherein said second means include a needle for insertion through a backing, a plunger having a rounded end for pushing at least one loop of yarn through the backing to a predetermined distance beyond the backing at the point of insertion of said needle, and a cutting blade for cutting the loop of yarn; said needle being channel-like, hollow and open on one side and receiving said cutting blade and plunger longitudinally and slidably therewithin such that said needle, cutting blade and plunger are aligned and parallel to one another, said cutting blade being intermediate said plunger and the closed side of said needle.

12. The improved tufting machine of claim 11 wherein said second means further include slide means mounted on the exterior of said support arm for individually and separately reciprocating said needle, cutting blade and plunger; said crank means being connected to and operating said slide means.

13. The improved tufting machine of claim 12 wherein said slide means include a plurality of elongated, rigid slide bars fitted for sliding reciprocation on opposing exterior surfaces of said arm; one slide bar supporting and rigidly secured to each of said needle, cutting blade, and plunger; said drive means including a housing with drive shaft extending out of opposite sides of said housing; said crank means including a crank arm fixedly secured to each end of said shaft on opposite sides of said housing and at least one connecting arm pivotally secured between each of said slide bars and one of said crank arms.

14. The improved tufting machine of claim 13 wherein at least one of said connecting arms includes a hollow tube, a rod telescoped within said tube, and means for clamping said rod in a predetermined position within said tube.

15. The improved tufting machine of claim 13 wherein said support arm includes a recessed area therewithin; said slide bar supporting said cutting blade includes a plurality of spaced apertures; a cutting blade support block secured to one of said spaced apertures in said cutting blade support bar and including clamping means for securing said cutting blade; said cutting blade being clamped to said support block in said clamping means.

16. The improved tufting machine of claim 12 wherein said support arm includes an internal passageway having portions leading from an exterior lubricant insertion opening to said slide means, and closure means for opening and closing said lubricant insertion opening.

17. The improved tufting machine of claim 11 wherein said camming means include a camming surface configured to operate said yarn gripping means to hold at least one previously formed yarn loop or tuft against the backing material during a period beginning at least simultaneously with the entry of said plunger through said backing, extending through the entire loop forming operation and any loop cutting operation, and ending at least simultaneously with the withdrawal of said cutting blade through said backing following any cutting of the formed loop.

18. The tufting machine of claim 11 including a yarn latch for holding the yarn on the other side of said second means during any cutting of said yarn loops by said second means, said yarn latch being mounted on and movable with said needle and including a flexible, resilient, yarn-engaging member for pressing a portion of the continuous length of yarn near said point of insertion through the backing material against a fixed yarn support to hold said yarn from further extension and allow formation of the yarn loop to a precise height, and a U-shaped yarn guide member for guiding and controlling the flow of yarn through said latch.

19. The tufting machine of claim 18 wherein said U-shaped yarn guide member is secured adjacent one end of said yarn latch where the yarn enters said yarn latch, and a second U-shaped yarn guide member is secured adjacent the opposite end of said yarn latch where the yarn exits said latch to confine and control the yarn.

20. The tufting machine of claim 1 including second yarn holding means for holding the yarn on the other side of said second means during any cutting of said yarn loops thereby.

21. The tufting machine of claim 20 wherein the first of said yarn holding means is on the trailing side of said second means and said second of said yarn holding means is on the leading side of said second means.

22. The tufting machine of claim 21 including a yarn guide tube extending along said tufter for guiding yarn to said second yarn holding means; said yarn guide tube including yarn engaging means for holding the yarn within said tube.

23. The tufting machine of claim 22 wherein said yarn engaging means include a relieved portion in said tube, a clamping member corresponding in shape to said relieved portion, biasing means for urging said clamping member into said relieved portion and against said tube and securing means for securing said biasing means on said tufting machine.

24. The tufting machine of claim 23 wherein said biasing means include a leaf spring; said securing means including a holding member secured to said yarn guide tube, said holding member including means for supporting said leaf spring at various positions along its length whereby the clamping force exerted on said clamping member may be adjusted.

25. A tufting machine for forming loop or cut pile fabrics comprising an elongated, rigid support arm; slide means on said support arm for individually slidably supporting and reciprocating a hollow, channel-like needle having a channel opening along one side, a cutting blade and a plunger at one end of said support arm, said plunger and cutting blade being nested within said channel opening of said needle with said cutting blade intermediate said plunger and needle and slidably engaged and supported thereby, said needle adapted to form successive openings through a backing material, said plunger adapted to push a loop of yarn of predetermined length through each of said openings, and said cutting blade adpated to cut said loops into cut pile tufts as desired; first extendible yarn-holding means for positively holding the yarn against the backing material on one side of said needle during formation of the loops by said plunger; and second yarn-holding means for clamping and holding the yarn on the opposite side of said needle during any cutting of the formed loops by said cutting blade whereby formation and any cutting of the yarn loops is precisely controlled to produce a tufted fabric with cut or loop pile of precisely even height; drive means for reciprocating said slide means, and thus, said needle, cutting blade and plunger in timed relationship with respect to one another; and camming means for extending said first yarn-holding means independently of but during operation of said needle, plunger and cutting blade.

26. The tufting machine of claim 25 wherein said drive means include rotating crank means for reciprocating said slide means.

27. The tufting machine of claim 25 wherein a first portion of said second yarn-holding means is mounted on said needle for reciprocal movement with said needle and a second portion of said second yarn-holding means is fixedly mounted on said support arm.

28. The tufting machine of claim 25 including a support handle mounted for rotational movement about said machine; clamping means for securing said support handle in a desired position.

29. The tufting machine of claim 25 wherein said first extendible yarn-holding means include a yarn gripping member and reciprocating means for reciprocating said yarn gripping member into and out of engagement with said yarn and backing material; said camming means including a rotating shaft with a cam surface thereon, said cam surface continuously engaging said reciprocating means to operate said yarn gripping member when said shaft is rotated.

30. The tufting machine of claim 29 wherein said reciprocating means include a cam follower, an elongated connecting means for connecting said yarn gripping member and cam follower, means for slidably mounting said connecting means, and biasing means for urging said cam follower into engagement with said cam surface.

31. The improved tufting machine of claim 30 wherein said support arm includes a free end; said means for slidably mounting said connecting means include a hollow tube secured adjacent said free end of said support arm; said connecting means including an elongated connecting member slidably telescoped through said hollow tube; a foot for engaging the backing material; and means for securing said foot to the exterior of said hollow tube.

32. In a tufting machine for forming loop or cut pile fabrics including an elongated, rigid support arm; first means on said support arm for engaging a backing material; second means on said support arm for forming successive loop tufts from a continuous length of yarn in the backing material and for cutting said loop tufts, said second means including a reciprocal plunger for projecting through the backing material to form loops of yarn and a reciprocal cutting blade for projecting through the backing to cut the yarn loops to form cut pile tufts; first yarn holding means on at least one side of said second means for holding the yarn of at least one previously formed loop against the backing material on said one side of said second means during cutting and forming of said loop or cut pile tufts, second yarn holding means for holding the yarn on the opposite side of said second means during a predetermined period of the operation of said second means; the improvement comprising:

drive means for operating said second means and said first yarn holding means including crank means for operating said second means and camming means for operating said first yarn holding means independently of said second means during a predetermined portion of the operation of said second means; said camming means including a camming surface configured to operate said first yarn holding means to hold at least one previously formed yarn loop or tuft against the backing material during a period beginning at least simultaneously with the entry of said plunger through said backing, extending through the entire loop forming and loop cutting operation of said second means, and ending at least simultaneously with the withdrawal of said cutting blade through said backing following any cutting of the formed loop; said second yarn holding means including means for engaging and preventing further extension of said yarn during a period beginning slightly before the full extension of said cutting blade and cutting of a formed loop and extending through the actual cutting of such loop.

* * * * *

UNITED STATES PATENT AND TRADEMARK OFFICE

CERTIFICATE OF CORRECTION

PATENT NO. : 4,267,784

DATED : May 19, 1981

INVENTOR(S) : Theodore C. Heemstra

It is certified that error appears in the above—identified patent and that said Letters Patent is hereby corrected as shown below:

Column 3, lines 6 and 7:

"rubbering" should be --- rubberizing ---

Column 6, line 40:

"66" should be --- 65 ---

Column 8, line 53:

after "preferably" insert --- at ---

Column 9, line 52:

after "pivot" insert --- post ---

Column 14, line 11:

"is" should be --- in ---

UNITED STATES PATENT AND TRADEMARK OFFICE

CERTIFICATE OF CORRECTION

PATENT NO. : 4,267,784

DATED : May 19, 1981

INVENTOR(S) : Theodore C. Heemstra

It is certified that error appears in the above—identified patent and that said Letters Patent is hereby corrected as shown below:

Column 14, line 66:

"toward and" should be --- toward the ---

Column 15, line 4:

"shwon" should be --- shown ---.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*